US008235880B2

(12) United States Patent
Guier

(10) Patent No.: US 8,235,880 B2
(45) Date of Patent: Aug. 7, 2012

(54) APPARATUS AND METHODS OF PACKAGING GOLF BALLS

(76) Inventor: Ryan Edmund Guier, Austin, TX (US)

( * ) Notice: Subject to any disclaimer, the term of this patent is extended or adjusted under 35 U.S.C. 154(b) by 0 days.

(21) Appl. No.: 13/004,332

(22) Filed: Jan. 11, 2011

(65) Prior Publication Data

US 2011/0168588 A1 Jul. 14, 2011

Related U.S. Application Data

(63) Continuation of application No. 12/686,144, filed on Jan. 12, 2010, now abandoned.

(51) Int. Cl.
*B31B 1/26* (2006.01)

(52) U.S. Cl. .... 493/405; D21/791; 473/409; 206/315.9; 206/579; 229/103; 273/402

(58) Field of Classification Search ..... D21/791; 206/315.9, 579, 767, 768, 45.2, 45.21–45.29; 220/62.1; 229/146, 145, 103; 473/195, 160, 473/409; 273/402, 352; 53/396; 493/405
See application file for complete search history.

(56) References Cited

U.S. PATENT DOCUMENTS

| | | | | |
|---|---|---|---|---|
| 3,700,243 | A | 10/1972 | Kenney | |
| 4,049,190 | A | 9/1977 | O'Neill | |
| 5,007,530 | A * | 4/1991 | Weismantel | 206/45.21 |
| 5,144,914 | A * | 9/1992 | Giannakopoulos | 119/168 |
| D481,092 | S | 10/2003 | Ray | |
| 6,743,490 | B2 | 6/2004 | Fushihara et al. | |
| 6,755,711 | B2 * | 6/2004 | McClung et al. | 446/46 |
| 2007/0227943 | A1 * | 10/2007 | Foushee | 206/775 |

OTHER PUBLICATIONS

International Search Report and Written Opinion dated Apr. 15, 2011 for International Application No. PCT/US2011/020813, International Filing Date: Jan. 11, 2011 consisting of 11-pages.

* cited by examiner

*Primary Examiner* — J. Gregory Pickett
*Assistant Examiner* — Andrew Perreault
(74) *Attorney, Agent, or Firm* — Matthew E. Burr

(57) ABSTRACT

Embodiments include a golf ball packaging box that can be converted into a putting aid. The golf ball packaging box is configurable to be positioned in a first configuration to package golf balls for sale and is configurable to be positioned in a second configuration to present a putting aid.

4 Claims, 8 Drawing Sheets

APPARATUS AND METHODS OF PACKAGING GOLF BALLS

PRIORITY

This application claims priority of, and is a continuation of, U.S. patent application Ser. No. 12/686,144, filed on 12 Jan. 2010, now abandoned which application is incorporated herein in its entirety.

FIELD

This written description is in the field of apparatuses and methods of packaging golf balls.

BRIEF DESCRIPTION OF THE DRAWINGS

Aspects of embodiments will become apparent upon reading the following detailed description and upon reference to the accompanying drawings in which like references may indicate similar elements.

DETAILED DESCRIPTION

The following is a detailed description of embodiments depicted in the accompanying drawings. The amount of detail offered is not intended to limit the anticipated variations of embodiments; but, on the contrary, the intention is to cover modifications, equivalents, and alternatives falling within the scope of the appended claims. The detailed descriptions below are designed to make such embodiments obvious to a person of ordinary skill in the art.

Embodiments include a golf ball packaging box that can be converted into a putting aid. The golf ball packaging box is configurable to be positioned in a first configuration to package golf balls for sale and is configurable to be positioned in a second configuration to present a putting aid.

Another embodiment is a golf ball box. The golf ball box includes a first portion and a second portion. The first portion is positionable with respect to the second portion in a first configuration to enclose golf balls. The first portion is positionable with respect to the second portion in a second configuration to present a putting aid.

Another embodiment is a golf ball package positioned in a first configuration to ship golf balls and positionable in a second configuration to present a putting aid in a diagonally inclined surface of the golf ball package, the diagonally inclined surface having an edge positionable on a flat surface.

Figure 1:
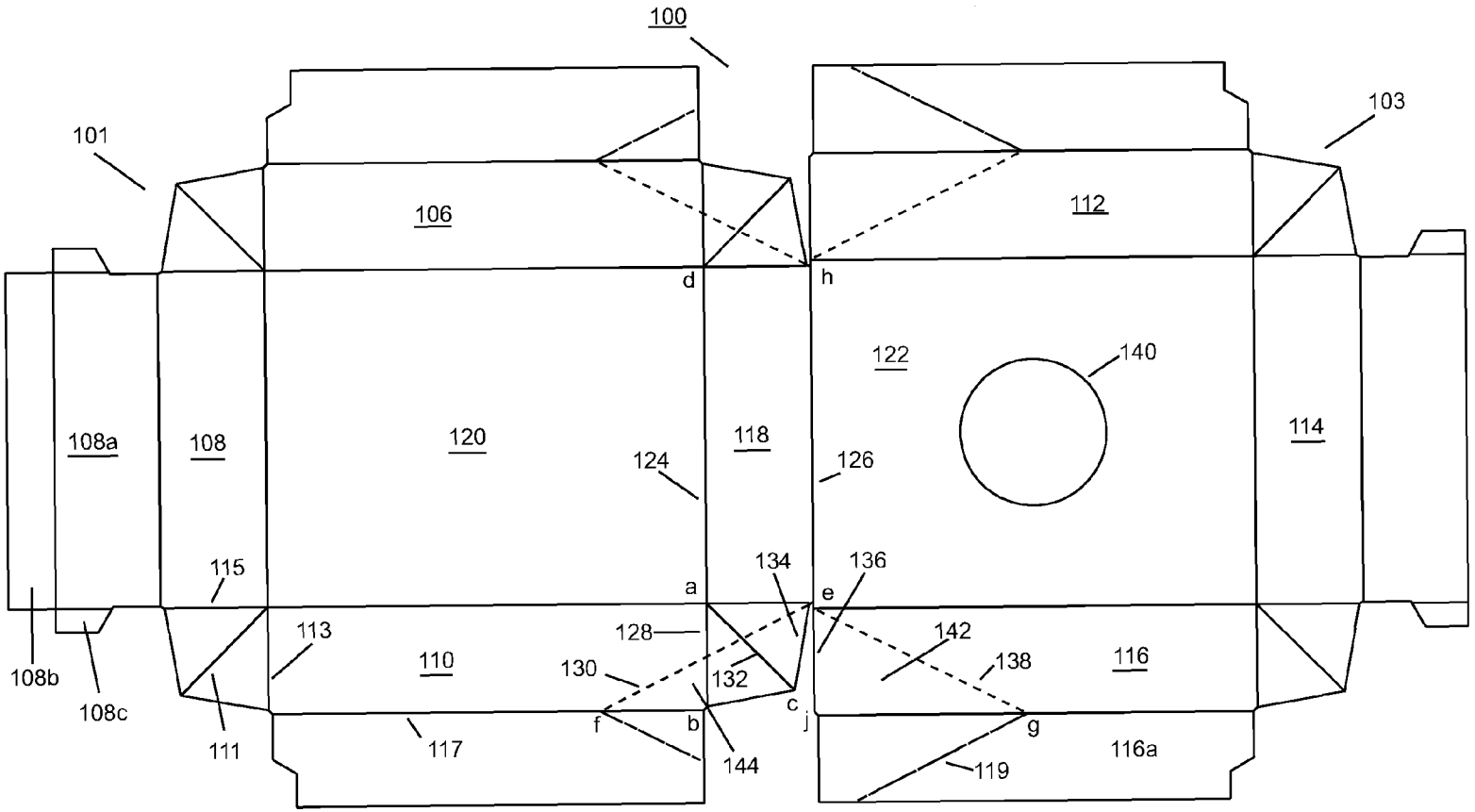
FIG. 1 depicts a blank of container material to form a golf ball package that is convertible to a putting aid.
Figure 2:
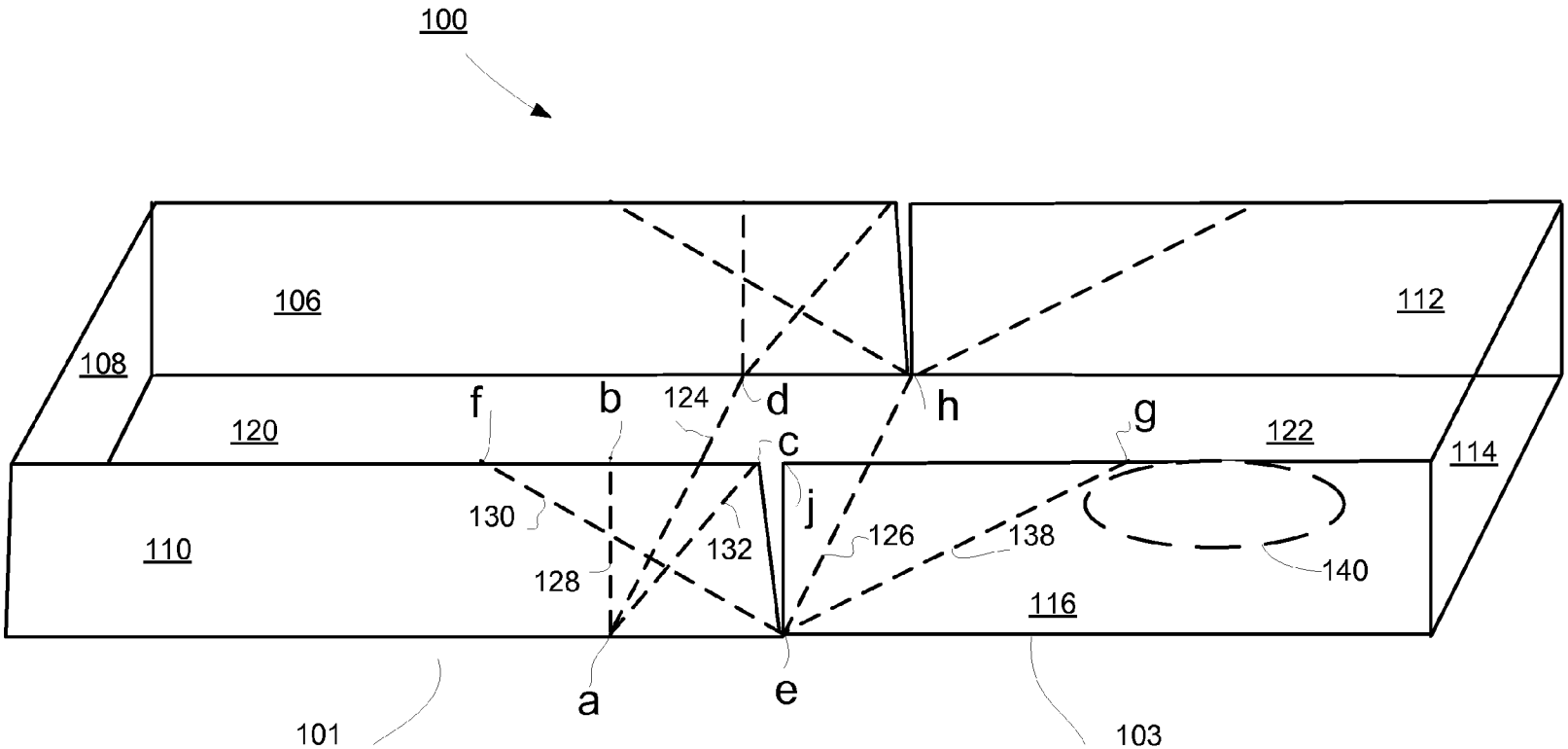
FIG. 2 depicts an embodiment of a golf ball package in an open position.
Figure 3:
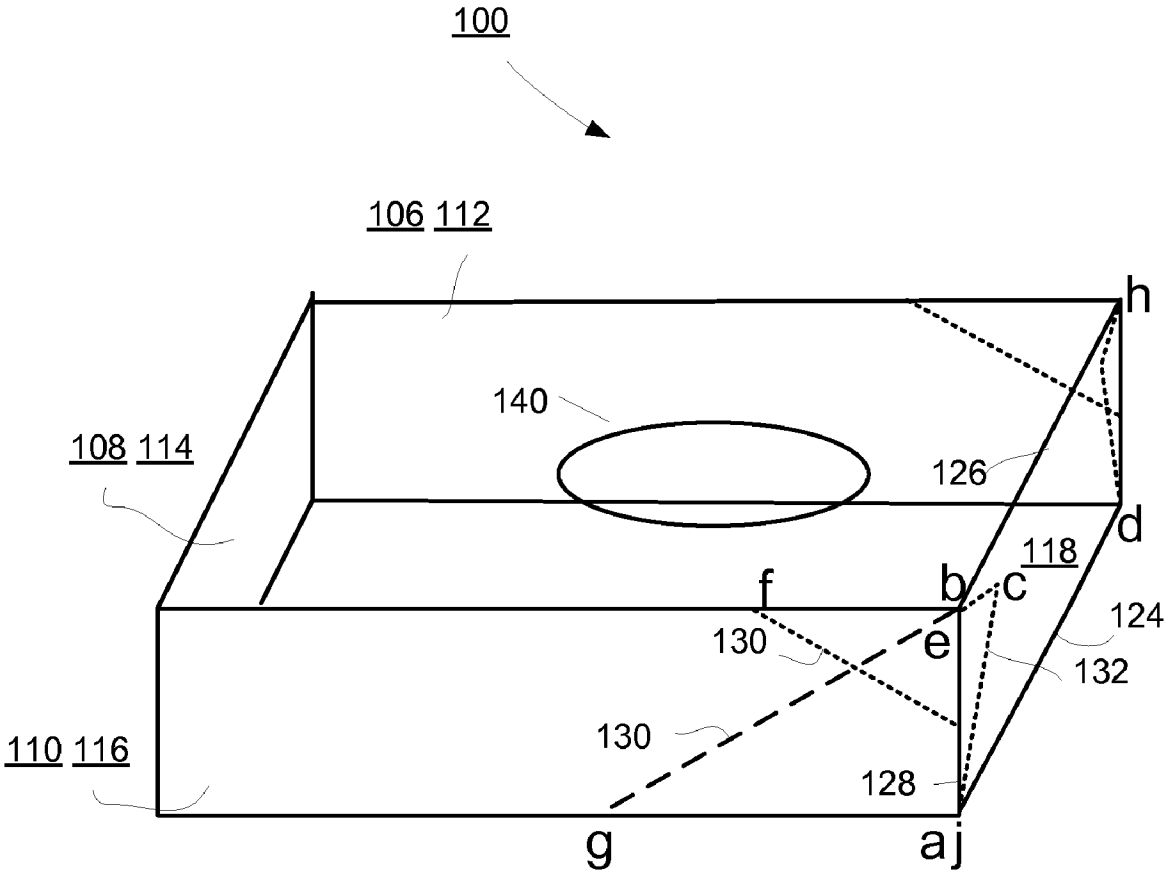
FIG. 3 depicts an embodiment of a golf ball package in a closed position.
Figure 4:
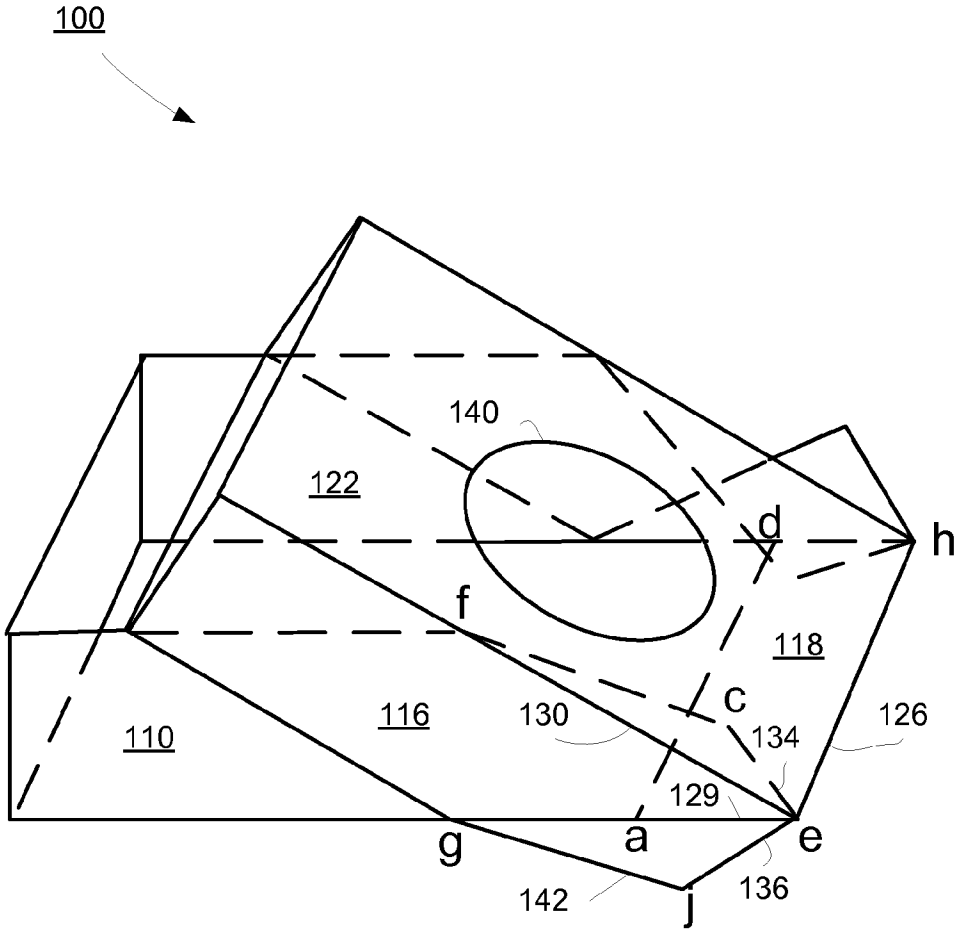
FIG. 4 depicts an embodiment of a golf ball package in a putting aid position.
Figure 5:
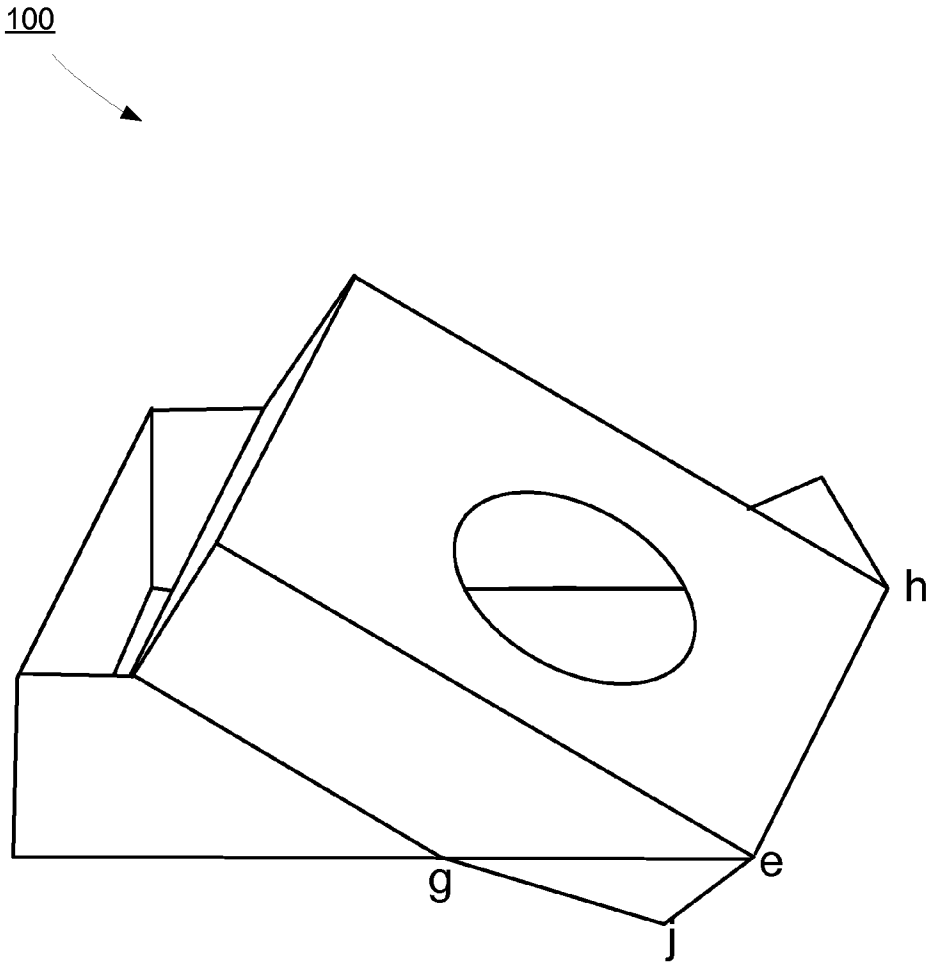
FIG. 5 depicts an embodiment of a golf ball package in a putting aid position.

FIG. 1 shows a layout of a pattern that may be used to construct a golf ball box 100 that is configurable to produce a putting aid. FIG. 2 depicts a first position of an embodiment of a golf ball box 100 that is in an open position. FIG. 3 depicts a closed position of an embodiment of a golf ball box. FIGS. 4 and 5 depict the golf ball box in a putting aid position.

Figure 2A:
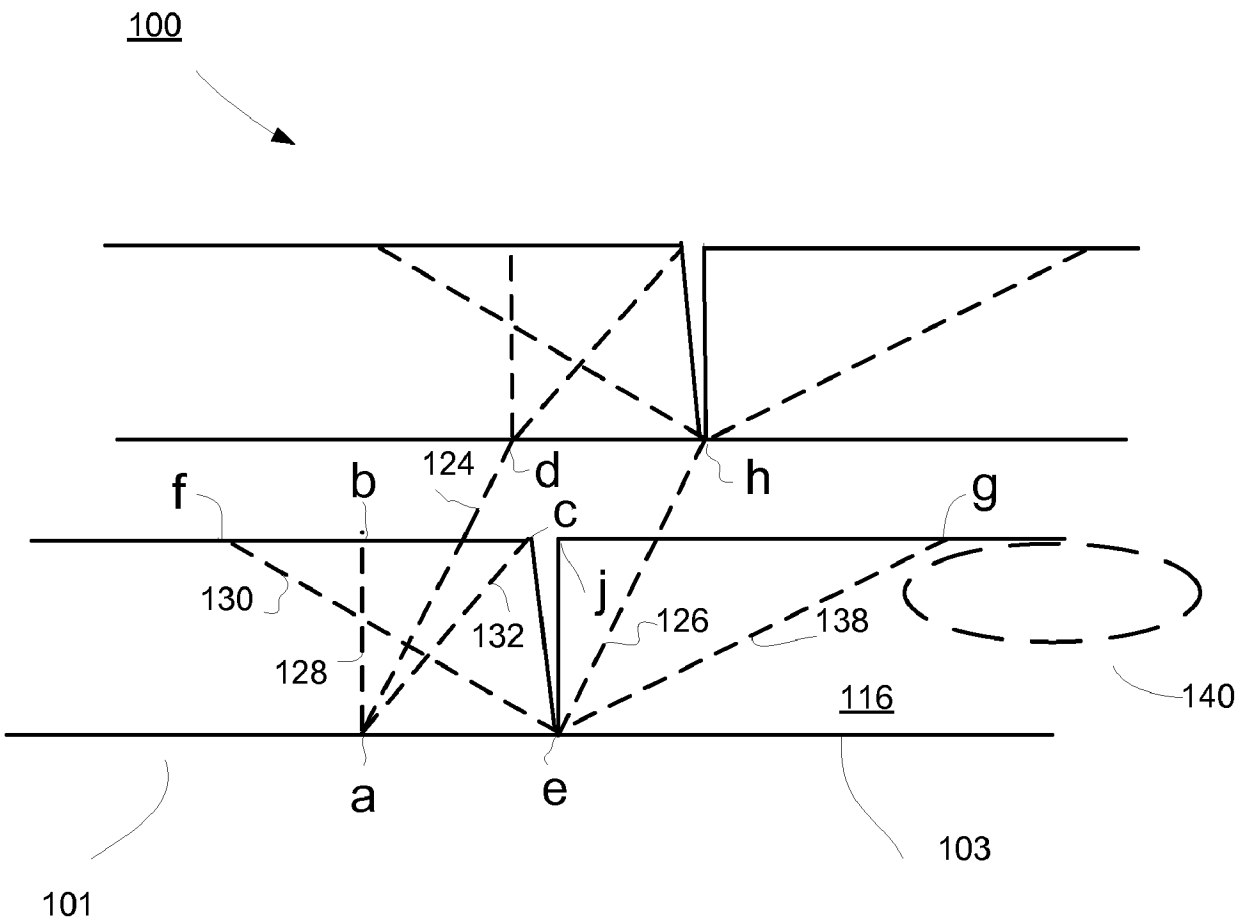
FIG. 2A depicts a segment of a golf ball package including folding lines for configuring the package into a putting aid.

Referring to FIG. 1, a layout of a pattern of cardboard 100 or other comparable material that can be configured as a golf ball box is shown. FIG. 2 shows the golf ball box in the fully open position. FIG. 2A shows a segment of the golf ball box showing folding lines for configuring the box into a putting aid. The golf ball box 100 has a top portion 103 and a bottom portion 101. The top portion 103 has an end panel 114 of the top portion 103, a left panel 112 of the top portion 103, a right panel 116 of the top portion 103, and a top panel 122 of the top portion 103. The left panel 112, the right panel 116, and the end panel 114, each emanate from a different one of the four edges of the top panel 122. The top panel 122 of the top portion 103 has a hole 140 having a diameter slightly larger than the diameter of a golf ball.

The bottom portion 101 has an end panel 108 of the bottom portion 101, a left panel 106 of the bottom portion 101, a right panel 110 of the bottom portion 101, and a bottom panel 120 of the bottom portion 101. The left panel 106, the right panel 110, and the end panel 108, each emanate from a different one of the four edges of the bottom panel 120. The left and right side panels 106, 112, 110, and 116, each are attached to a folding flap such as folding flap 116*a*. A folding flap is folded along a line shared by a side panel and the folding flap, such as line 117, and may be glued to reinforce the side panel. The end panel 108 of the bottom portion 101 is attached to reinforcement flaps 108*a*, 108*b*, and 108*c*, which are folded and glued to form an end side of the golf ball box. Similar panels are affixed to the end panel 114 of the top portion 103. A corner piece shares an edge 113 of the side panel 110 and shares and edge 115 of the end panel 108. The corner piece is folded along lines 111, 113, and 115 when forming the right side of the bottom portion and the end side of the bottom portion of the box. Similar corner pieces are at each corner.

In the fully open position, as shown in FIG. 2, the left 112, right 116, and end panel 114 of the top portion 103 are vertical. The left 106, right 110, and end panel 108 of the bottom portion 101 are also vertical. A middle panel 118 is horizontal and shares a first edge 126 with the top panel 122 of the top portion 103, and shares a second edge 124 with the bottom panel 120 of the bottom portion 101.

The top and bottom portion form a golf ball box in a closed position sharing a middle panel 118 when the top portion 103 is positioned with respect to the bottom portion 101 so that the left 112, right 116 and end panels 114 of the top portion 103 overlap the left 106, right 110 and end panels 108 of the bottom portion, respectively. The middle panel 118 is vertical and shares the second edge 124 with the bottom panel 120 and shares the first edge 126 with the top panel 122. When in the closed position, as shown in FIG. 3, the top panel 122 of the top portion 103 is parallel to the bottom panel 120 of the bottom portion 101, and all the side panels 106, 112, 108, 114, 110, and 116 are vertical.

When the box is in the closed position, a portion of the left 106 and right 110 panels of the bottom portion 101 are folded about a first vertical line 128 and a first diagonal folding line 132 of the left 106 and right 110 panels, and the middle panel 118 is folded along an edge 124 of the middle panel 118. The first vertical line 128 extends vertically from a corner (a) of the bottom panel 120 about an inch from the edge 134. The first diagonal folding line 132 extends from the corner (a) of the bottom panel 120 toward a corner (c) of the side panel 110. It will be understood, that a corresponding first diagonal folding line 132 is formed on side panel 106.

The golf ball box 100 can be configured into a putting aid by folding first polygonal end portions 144 (cefbc) of the left 106 and right 110 panels of the bottom portion 101 inward toward an inside of the box along second diagonal folding lines 130 so that the bottom portion exhibits first left and right diagonal edges 130. The second diagonal folding lines 130 extend from corners of the top panel 122 toward an upper edge of the left 106 and right 110 side panels of the bottom portion 101.

Further, the box is configured for the putting aid by folding second polygonal portions 142 (jegj) of the left 112 and right 116 panels of the top portion 103 outward away from the inside of the box along third diagonal folding lines 138 so that the top portion 103 exhibits first left and right polygonal surfaces 142 that are flush with the bottom panel 120 of the bottom portion 101. The third diagonal folding lines 138 extend from corners of the top panel 122 to upper edges of the left 112 and right 116 side panels of the top portion 103. It will be understood that the second and third diagonal lines are marked in the left and right panels of the bottom portion and top portion, respectively, as shown in FIGS. 1 and 2.

The top portion 103 is positioned with respect to the bottom portion 101 so that the top panel 122 of the top portion 103 is positioned at an angle with respect to the bottom portion 101, the angle formed by the first left and right diagonal edges 130. In the putting aid position, the bottom panel 120 and the middle panel 118 are both horizontal, thereby exhibiting the edge 128 shared by the middle panel 118 and top panel 122, and exhibiting the hole 140 in an inclined plane formed by top panel 122.

In some embodiments, the first diagonal folding lines 132 of the left 106 and right 110 panels of the bottom portion are at an angle of about 45 degrees with respect to the bottom panel of the bottom portion. The second diagonal folding lines 130 may be at an angle of about 30 degrees with respect to the bottom panel 120 of the bottom portion 101. The third diagonal folding lines 138 may be at an angle of about 30 degrees with respect to the top panel 122 of the top portion 103. In some embodiments, the folding lines are marked with ink and/or perforated.

In the closed position of FIG. 3, the size of the enclosure is sufficient to package 12 golf balls in a 4-by-3 array of golf balls. In other embodiments, the size of the enclosure is sufficient to package other numbers of golf balls. The opening 140 may display a golf ball when the golf ball package is positioned in a first configuration, as shown in FIG. 2, and the opening 140 forms a putting target when the golf ball package is positioned in the configuration shown in FIG. 4.

Thus, to position the golf ball package in the closed configuration of FIG. 2, one folds the golf ball package along the lines ac 132, ae 129, ab 128, ad 124, and eh 126. The two panels adjacent to the line ac fold inward to an interior of the golf ball package 100, as shown by the triangle abc in FIG. 2. The middle panel 118 folds upwards about line ad to a vertical position and the top portion 103 folds along the line eh to enclose the bottom portion 101. When converting the golf ball package 100 from the open position of FIG. 2 to the closed position of FIG. 3, no fold is taken along lines ef 130, or eg 138. In the configuration of FIG. 3 only part of the line ef is shown, for clarity. Note that the opening 140 may be positioned to provide visibility of a golf ball. A thin film of removable transparent material may cover the opening 140 to display a golf ball.

To position the golf ball package in the putting aid configuration of FIG. 4, one folds along the lines ef, eg, and eh. The fold along the line ef is an inward fold so that the triangle efc folds inward to an interior of the configuration of FIG. 4. The fold along the line eg is an outward fold so that the triangle egj folds outward to an exterior of the configuration of FIG. 4. The fold along the line eh, with the middle panel 118 face down, positions the top portion 103 to rest against panels of the bottom portion 101, such that an edge at line eh is presented to a golf ball in motion toward the putting aid 100. The top portion 103 presents an inclined surface that allows a golf ball arriving at line eh to roll upward on a surface presented by top portion 103. The golf ball that rolls upward on the surface presented by the top portion 103 may be received by the opening 140.

In some embodiments, one or more of the lines ab, ac, ae, ad, eh, and eg may be marked with ink along the line and or may be perforated along the line. Instructions for folding along the lines ef, eg, and eh to form the putting aid may be included in the golf ball package or printed on the golf ball package. The instructions may include a picture of the golf ball package in a putting aid configuration, such as shown in FIG. 4 or 5. Note that a golf ball package may have other lines for folding along to create a closed configuration or a putting aid configuration.

Thus, one embodiment is a golf ball box that is marked with lines about which side panels of the box may be folded to form a putting aid, the box being marked with a first set of diagonal lines about which opposite side panels of a bottom portion of the box may be folded inward to form two diagonal edges against which a top portion of the box may be positioned to form a diagonal surface exhibiting an opening in a top panel of the top portion to form the putting aid. Another embodiment is a golf ball box that is configurable to form a putting aid. The configurable golf ball box has a bottom portion having panels marked with first diagonal lines about which a first polygonal portion is folded inwardly on each panel to form diagonal edges. The box also includes a top portion with an opening to receive a golf ball, the top portion being positionable to rest against the diagonal edges to present an inclined surface that exhibits the opening. The top portion may have panels marked with second diagonal lines about which a second polygonal portion is folded outwardly. Each second polygonal portion is substantially horizontal when the box is configured to form the putting aid.

FIG. 5 is similar to FIG. 4 without the hidden lines in order to show the configuration of FIG. 3 more clearly. In FIG. 4, the opening 140 may be positioned at a particular height to present an optimal putting practice experience. If the opening is positioned low, then sinking the golf ball into the hole presented by the opening 404 requires less force than if the opening position is positioned higher. In some embodiments, the positioning of the opening 140 is such that the center of the opening is about in the middle of the top portion 303. A diameter of the opening 140 may be about the same diameter as an actual golf cup. The size and height of the opening 140 may be varied to produce an optimal putting practice experience.

Therefore, when a golfer buys a box of golf balls he gets a putting aid as part of the bargain. The embodiment of FIG. 4 exhibits a line eh forming an edge 126. The opening 140 in an inclined plane forms a putting target. In some embodiments, an inclined surface may be provided that is not planar, but rather, is curved. In some embodiments, a curved shape of the inclined surface may guide a golf ball to the opening 404. Thus, in some embodiments, the top portion 103 may be preformed, folded, or cut to exhibit a curved surface or a channel bounded in part by an edge of the putting aid that lies along a floor when the putting aid is placed on the floor. In the embodiment of FIG. 4, the bottom portion A101 forms a tray to receive a putted ball that enters through the opening 140.

Persons of ordinary skill in the art will recognize that the functions of the bottom portion 101 and the top portion 103 may be interchanged so that in a complementary configuration, the bottom portion has an opening and presents a putting aid, while the top portion provides a tray for receiving a putted ball. Also, the interior of the golf ball package may be one color and the exterior may be another color to make the opening more visible from a distance.

Figure 6:
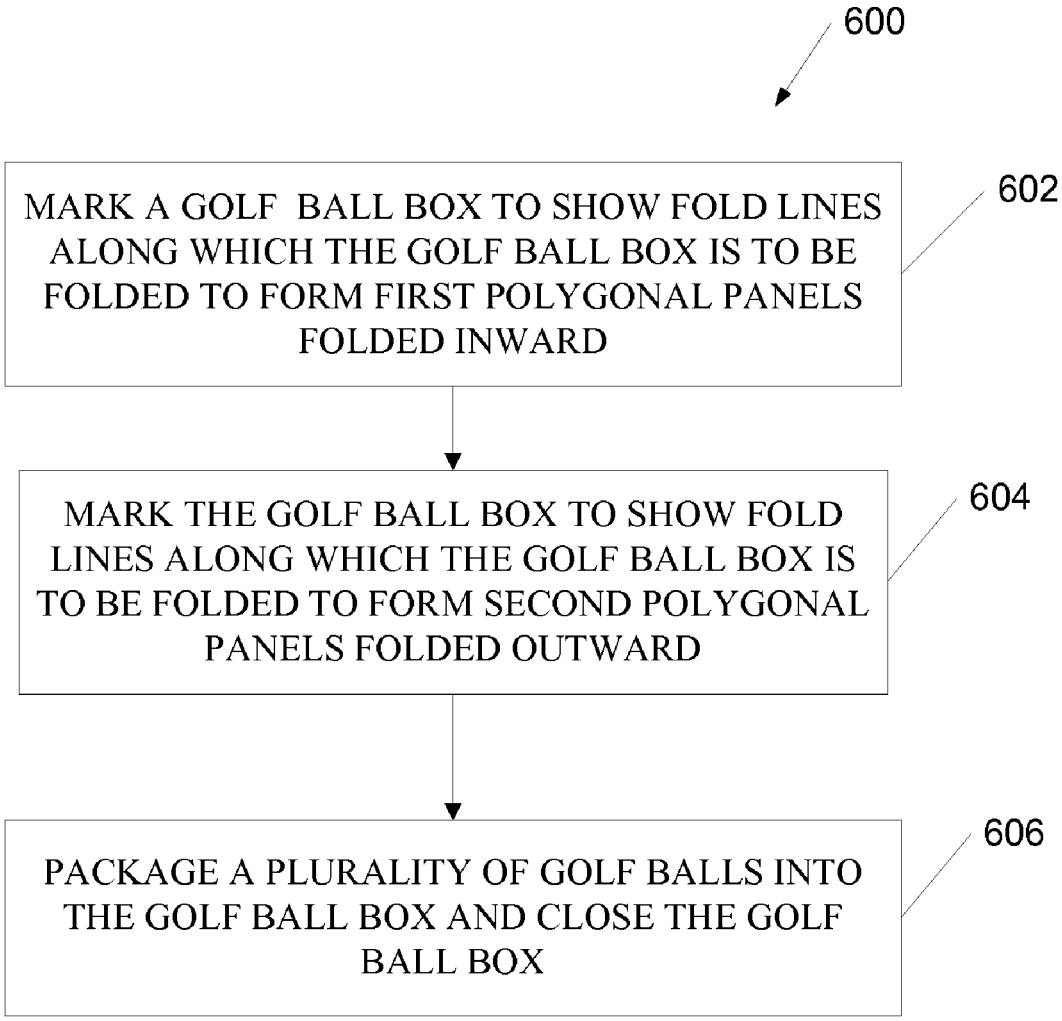
FIG. 6 depicts a flowchart of an embodiment of a method for making and packing a golf ball package.

FIG. 6 depicts a flow chart 600 of one embodiment of a method of presenting a putting aid using a golf ball box. A golf ball box is marked or perforated to show fold lines along which the golf ball box is to be folded to form first polygonal panels folded inward (602). The method further includes marking or perforating the golf ball box to show fold lines along which the golf ball box is to be folded to form second polygonal panels folded outward (604). A plurality of golf balls may then be packed into the golf ball box and the golf ball box can be closed for shipping, at (606). In some embodiments, the golf balls packed into the golf ball box may be packed into smaller boxes of two or three golf balls.

Figure 7:
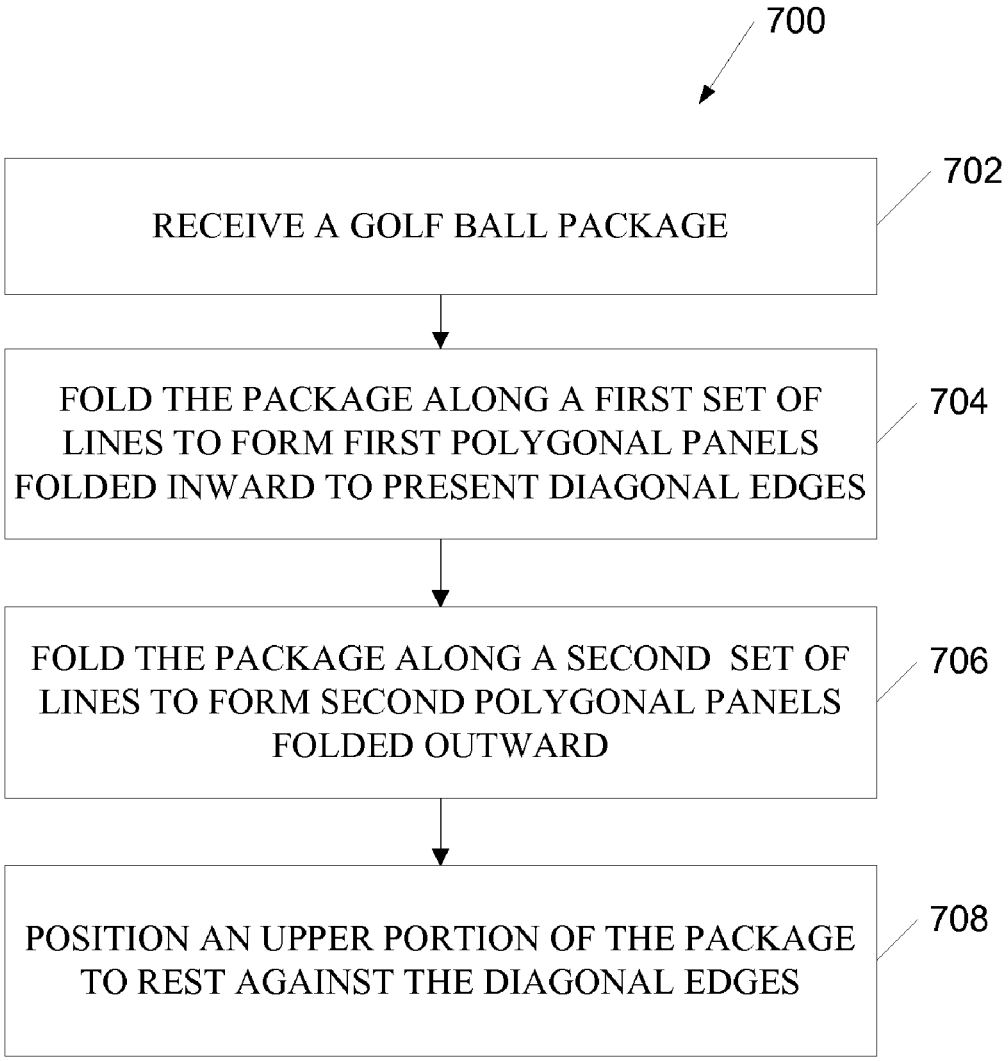
FIG. 7 depicts a flowchart of an embodiment of a method for receiving a golf ball package and configuring the golf ball package into a putting aid.

FIG. 7 depicts a flow chart 700 of an embodiment of a method for obtaining a putting aid from a golf ball box. More particularly, the golf ball box may be configured to present a putting aid with an inclined surface having an edge that can lay upon a floor. Therefore, a golfer may buy or otherwise receive a golf ball package, (702). The golf ball package can be folded along a first set of lines to form first polygonal panels folded inward to present diagonal edges, (704). The package is further folded along a second set of lines to form second polygonal panels folded outward, (706). An upper portion of the package is then positioned to rest against the diagonal edges, (708), to form a putting aid.

Various changes, substitutions and alterations can be made to the embodiments described herein without departing from the scope of the appended claims. An embodiment may achieve multiple objectives, but not every embodiment falling within the scope of the attached claims will achieve every objective. Moreover, the scope of the present application is not intended to be limited to the particular embodiments of the process, machine, manufacture, composition of matter, means, methods and steps described in the specification. One of ordinary skill in the art will readily appreciate from this disclosure that processes, machines, manufacture, compositions of matter, means, methods, or steps, presently existing or later to be developed are equivalent to, and fall within the scope of what is claimed. Accordingly, the appended claims are intended to include within their scope such processes, machines, manufacture, compositions of matter, means, methods, or steps.

What is claimed is:

1. A method of converting a golf ball box into a putting aid, the golf ball box having a top portion and a bottom portion, the top portion having an end panel of the top portion, a left panel of the top portion, a right panel of the top portion, and a top panel of the top portion, the top panel of the top portion having a hole having a diameter larger than the diameter of a golf ball, the end panel of the top portion, the left panel of the top portion, and the right panel of the top portion each emanating from a different one of a plurality of edges of the top panel of the top portion, the bottom portion having an end panel of the bottom portion, a left panel of the bottom portion, a right panel of the bottom portion, and a bottom panel of the bottom portion, the end panel of the bottom portion, the left panel of the bottom portion, and the right panel of the bottom portion each emanating from a different one of a plurality of edges of the bottom panel, the top panel and the bottom panel adjacently attached to a middle panel and forming a golf ball box in a closed position when the top portion is positioned with respect to the bottom portion so that the left, right and end panels of the top portion overlap the left, right and end panels of the bottom portion, respectively, the left, right, end, and middle panels all being vertical, and the top panel of the top portion being parallel to the bottom panel of the bottom portion when the golf ball box is in the closed position, and wherein the left and right panels of the bottom portion each have a first diagonal folding line and a vertical folding line along which a portion of the left and right panels of the bottom portion fold inward, and the middle panel has an edge along which the middle panel is folded, when the golf ball box is in the closed position, the method comprising:

opening the golf ball box from the closed position;

folding first polygonal end portions of the left and right panels of the bottom portion inward toward an inside of the box along second diagonal folding lines so that the bottom portion exhibits first left and right diagonal edges, the second diagonal folding lines emanating from first corners of the middle panel and extending to an upper edge of the left and right panels of the bottom portion;

folding polygonal portions of the left and right panels of the top portion outward away from the inside of the box along third diagonal folding lines so that the top portion exhibits first left and right polygonal surfaces that are flush with the bottom panel of the bottom portion when the box is in the putting configuration, the third diagonal folding lines emanating from the first corners of the middle panel to an upper edge of the left and right panels of the top portion;

positioning the top portion with respect to the bottom portion so that the top panel of the top portion is positioned at an angle with respect to the bottom portion and forming a front edge of the top panel, the top panel of the top portion resting against the first left and right diagonal edges, the angle formed by the first left and right diagonal edges, the front edge of the top panel of the top portion being flush with the bottom panel of the bottom portion, the hole in the top panel of the top portion forming a putting aid.

2. The method of claim 1, wherein the first diagonal folding lines of the left and right panels of the bottom portion are at an angle of about 45 degrees with respect to the bottom panel of the bottom portion.

3. The method of claim 1 , wherein the second diagonal folding lines are at an angle of about 30 degrees with respect to the bottom panel of the bottom portion.

4. The method of claim 1 wherein the third diagonal folding lines are at an angle of about 30 degrees with respect to the top panel of the top portion.

* * * * *